United States Patent [19]

Krauter

[11] Patent Number: 4,974,497

[45] Date of Patent: Dec. 4, 1990

[54] HYDRAULIC MUSCLE TERMINATOR WITH BLEED SEAL

[75] Inventor: Allan I. Krauter, Syracuse, N.Y.

[73] Assignee: Welch Allyn, Inc., Skaneateles Falls, N.Y.

[21] Appl. No.: 476,945

[22] Filed: Feb. 8, 1990

[51] Int. Cl.[5] ..... F01B 19/00

[52] U.S. Cl. ..... 92/92; 92/91; 254/93 R

[58] Field of Search ..... 92/90, 91, 92; 128/4, 128/6; 254/93 R

[56] References Cited

U.S. PATENT DOCUMENTS

| | | | |
|---|---|---|---|
| 2,483,088 | 9/1949 | DeHaven | 92/92 X |
| 3,645,173 | 2/1972 | Yarlott | 92/92 |
| 3,924,519 | 12/1975 | England | 92/92 |
| 4,733,603 | 3/1988 | Kukolj | 92/92 |
| 4,739,692 | 4/1988 | Wassam et al. | 92/92 X |
| 4,751,869 | 6/1988 | Paynter | 92/92 |
| 4,794,912 | 1/1989 | Lia | 92/92 X |

*Primary Examiner*—John Rivell

*Attorney, Agent, or Firm*—Wall and Roehrig

[57] ABSTRACT

A terminator for a fluid actuated muscle has an axial bore and a removable seal pin that fits into an elastomeric tubular liner in the bore. The pin has a flattened outer end with a hole through it to facilitate extraction. The pin is removed to facilitate bleeding of air or other gases when the muscle is filled with hydraulic fluid. The pin can be held in place by a cable terminator that is fitted into the muscle terminator.

9 Claims, 1 Drawing Sheet

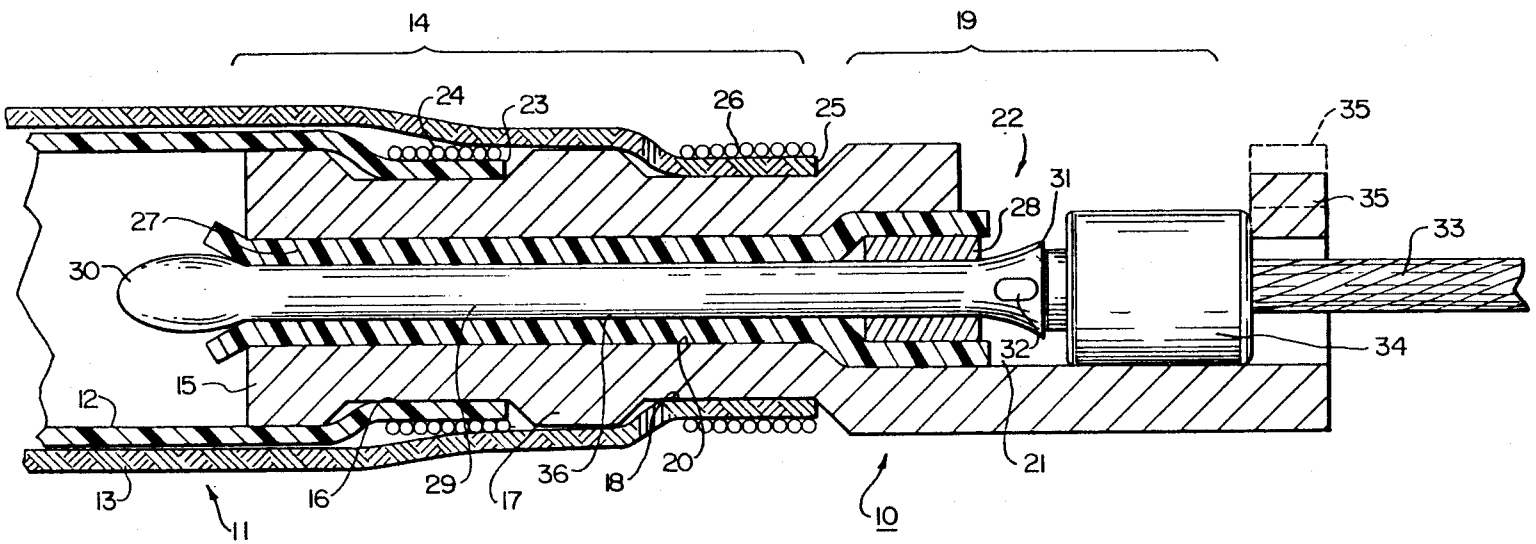
35
35
33
34
19
22
28
31
32
21
10
25
26
20
18
36
17
23
24
29
14
16
11
27
15
30
12
13

HYDRAULIC MUSCLE TERMINATOR WITH BLEED SEAL

BACKGROUND OF THE INVENTION

This invention relates to fluid actuators, and is more particularly concerned with a device that converts a fluid pressure to a tensive force, e.g., to exert a pull on a control cable or the like. The invention is more specifically directed to a terminator for a distal end of a hydraulic muscle that seals the end of an elongated bladder of the muscle, provides mechanical transfer of force from a braid of the muscle to the control cable or other mechanical device, and permits air or other gases to be bled from the bladder.

The invention can also be incorporated into a hydraulic pump which operates on the same principle as the hydraulic muscle.

Hydraulic muscles can favorably be employed within a borescope or endoscope to control the steering or bending at the distal tip, and to avoid the need for extremely long steering cables.

A borescope is generally characterized as an elongated flexible insertion tube with a viewing head at its distal or forward end, and a control housing at its proximal end for controlling or steering the distal or forward end. Such a borescope has a bendable-tube steering section or articulation section at the distal end adjacent the viewing head. One or two pairs of control cables extend through the articulation section, and then through the remainder of the flexible insertion tube. These cables connect with a steering control unit in the control section. One or both pairs of these cables are differentially displaced to bend the articulation section. The viewing head can thus be remotely oriented to facilitate the inspection of an object. Borescopes are intended for visual inspection of mechanical devices such as jet engines or turbines, where it would be difficult or impossible to examine the device's internal elements directly. The borescope needs to reach into narrow tortuous passageways, and must observe similar bending and steering considerations. In addition the pathway to the object can be quite long, and so it is often necessary that the borescope insertion tube be fifteen meters or longer.

Endoscopes are similar devices, but are intended to be inserted into a body cavity, such as the colon or esophagus, for visual investigation of tissues within the cavity.

A number of types of cable-actuated articulation or steering mechanisms are known, and typical ones are discussed in U.S. Pat. Nos. 3,610,231; 3,739,770; 3,583,393; 3,669,098; 3,779,151; and 4,347,837. Another steering mechanism is described in U.S. Pat. No. 4,700,693.

The articulation mechanisms for those previously-proposed endoscopes and borescopes require that the cables have a significant amount of slack or play because bends and coils in the insertion tube effectively shorten the cables and because the articulation section bends at discrete points rather than following a smooth curve. However, in both the borescope and endoscope, the articulation section must be bent rather precisely to penetrate into the area to be inspected without damaging delicate engine parts or injuring a patient's tissues. For these reasons cable tension must be limited and cable slack must be minimized. Where the insertion tube is long, extra cable slack is often included to accommodate the increased cable tightening due to the substantial coiling and bending of the insertion tube through which the steering cables pass.

Also, when the cables are differentially displaced to effect articulation, the cable displacement is not precisely reciprocal. That is, the motion of one cable is not the exact opposite of the other. This fact results in undesirable tensioning at some times, and at other times produces unwanted cable slack which can lead to imprecise steering. Coiling of the insertion tube can produce high tension in both cables of a cable pair, which can lead to increased friction and to high damaging forces on the cables and on the articulation section. If no measures are taken to compensate for this, early failure can follow. Even when only one cable carries tension, coiling of the insertion tube can produce sufficient friction on the cable to prevent articulation.

Ideally, the steering cables should be kept short to avoid the above problems. To do this, the cables should terminate within the insertion tube near the articulation section, and some mechanism to draw the cables should be incorporated within the sheath of the insertion tube. Unfortunately, no known existing mechanism had been proposed for this task until U.S. Pat. No. 4,794,912. This patent describes a braid-and-bladder pneumatic or hydraulic muscle that addresses many of the problems found in these prior borescope/endoscope steering mechanisms. Specifically, a fluid dynamic muscle mounted adjacent the distal end of the insertion tube is actuated by pneumatic or hydraulic pressure supplied through small flexible tubes within the borescope insertion tube. The muscle is mounted adjacent the flexible portion of the endoscope/borescope so that the bending cables can be very short and direct in the performance of their bending function without the limitations and problems of the much longer cables required in the conventional steering mechanisms. As fluid pressure is applied to the fluid muscle situated in the distal end of the borescope, the insertion tube bends in the desired direction to permit proper viewing. The problems of extremely long cables that flex, stretch, etc. are avoided. This allows a much more accurate and precise positioning of the viewing end of the borescope within the cavity being inspected.

Where longer distances are encountered from the fluid pressure source to the muscles, a hydraulic or liquid driven system is preferred because of the increased control and decreased response times. However, in such case it is essential to provide a highly reliable seal at the ends of the muscle bladder. It is also important to provide a bleed port through which air or other gases trapped in the bladder during fabrication can be removed from the hydraulic muscle.

OBJECTS AND SUMMARY OF THE INVENTION

It is an object of this invention to provide a hydraulically actuated device that overcomes the drawbacks of the prior art.

It is another object of this invention to provide a hydraulic muscle in which the distal end is sealed with a terminator member that permits bleeding of air or other gases from the liquid within the bladder, to minimize the compressibility or elasticity of the working hydraulic fluid.

It is still another object of the invention to provide an improved terminator for a hydraulic muscle.

According to an aspect of the invention, a terminator with bleed seal is provided for a hydraulic muscle of the type that has an elongated tubular elastomeric bladder situated within an elongated tubular braid. Hydraulic fluid is introduced into the interior of the tubular bladder so that the tubular braid expands radially and shortens axially as the fluid is introduced into the interior of the tubular bladder, and lengthens axially as the hydraulic fluid is withdrawn from it. The muscle terminator is a generally cylindrical elongated body situated at the distal end of the hydraulic muscle. The terminator seals the distal end of the bladder and provides mechanical transfer of force between the distal end of the braid and the proximal end of a cable or other member that is to be moved by the muscle.

The terminator has an obturator portion that fits into the distal end of the bladder to seal the same and also to attach mechanically to the distal end of the braid. An anchor portion is situated distal of the obturator portion and connects to the cable or other member. The cylindrical terminator has an axial bore that extends to the interior of the bladder. A tubular elastomeric liner is situated in the bore and an elongated pin is snugly but removably fitted into the bore within the liner. A distal portion of the pin remains outside the bore and liner, and is accessible to permit withdrawal of the pin, e.g. to bleed air from the bladder.

There is structure, e.g. in the anchor portion, to block axial movement of the pin out of the bore and liner, except when it is desired to withdraw the pin. Preferably the distal end of the bore is widened, and a retaining ring is inserted here to press the distal end of the liner outward against the widened part of the bore. This prevents the insertion or removal of the pin from pulling or pushing the liner out of the bore. In a favorable embodiment, the distal end of the pin is flared, and has a hole cut through it to permit grasping of the pin, e.g. with a dental pick or similar instrument, for extraction from the bore and liner. The proximal end of the pin should be rounded by removing a sharp edge or by tinning with solder.

The above and many other objects, features, and advantages of this invention will be more fully appreciated from the ensuing detailed description of a preferred embodiment, which should be read in connection with the accompanying Drawing.

BRIEF DESCRIPTION OF THE DRAWING

The sole Drawing FIGURE is a cross sectional view of a distal end of a hydraulic muscle, featuring a terminator with bleed seal according to a preferred emodiment of the present invention.

DETAILED DESCRIPTION OF THE PREFERRED EMBODIMENT

With reference to the Drawing FIGURE, a distal-end terminator 10 is provided for a hydraulic muscle 11 of the type that has a tubular elastomeric bladder 12 and a tubular braid 13 disposed over the bladder 12. The terminator 10 has an obturator portion 14 that is inserted into the distal end of the hydraulic muscle. An annular step or land 15 is formed at the proximal tip of the portion 14. An annular valley or recess 16 is situated distally of the step 15, and a second annular step or land 17 is situated distally of the recess 16 and separates it from a second annular valley or recess 18. An anchor portion 19 of the terminator 10 extends distally from the second valley 18.

There is an axial bore 20 extending through the obturator portion 14 for communication with the interior of the tubular bladder 12. The anchor portion 19 has a bore portion 21 of greater diameter than the bore 20; this bore portion connects with the distal end of the bore 20. The anchor portion 19 has a cutout 22 at one side, i.e. at the top of the Drawing, for access to elements that are seated within the terminator.

The terminator 10 is connected to the muscle 11 as shown. A distal end 23 of the bladder 12 is seated in the annular valley 16 and is tied down with wraps 24 of monofilament. A distal end 25 of the braid is placed into the second annular valley 18 and is likewise tied down with wraps 26 of the monofilament.

The terminator 10 seals the distal end of the bladder 12 and also provides mechanical transfer of force directly from the distal end 25 of the braid 13 to the anchor portion 19 of the terminator 10.

The bore 20 is provided to permit air or other gases to be bled or exhausted from the muscle 11 when the latter is being filled with hydraulic fluid.

Means provided to seal the bore 20 after a bleeding operation are constituted as follows: An elastomeric tubular liner 27 is fitted into the bore 20 and a retaining ring 28 is fitted into the distal end of the liner 27 to compress it against the bore portion 21. An elongated cylinder pin 29 is removably, but snugly inserted into the liner 27 from the anchor portion 19 of the terminator 10 to stop the bore 20. This pin 29 can be formed of stainless steel tubing, with a rounded proximal tip 30 formed with solder. A distal end 31 of the pin is flared and flattened so as to have a greater width than the inner diameter of the ring 28. This keeps the distal end of the pin to the distal side of the ring 28 after insertion. A small hole 32 through the flattened end 31 provides access for a dental pick or similar tool to facilitate removal when necessary.

A steering or control cable 33 has a generally cylindrical terminator 34 affixed onto its proximal end. The cable terminator 34 fits into the larger diameter bore portion 21 in the anchor portion 19 of the muscle terminator 10. For installation of the cable terminator, a distal end 35 of the anchor portion beyond the cutout stands in an open position, as shown in ghost lines. After installation, this distal end 35 can be crimped, as shown in solid lines, to block withdrawal of the cable terminator 34. The crimped end 35 can be opened out, if necessary. The cable terminator 34 blocks movement of the pin 29 from the bore 20.

The terminator 10 as described and shown can be readily assembled. After the bore 20 is formed the inside surface can be roughened slightly to facilitate an anti-sliding engagement with the liner 27. The elastomeric liner 27 is installed first by forming a small-diameter leader at one end. This can be accomplished by cutting a semi-cylindrical length. This is inserted through the distal bore portion 21 and then through the smaller axial bore 20, and is pulled until uncut tubing sufficient to form the liner 27 is pulled into the bore 20. Alternatively, a portion of the elastomeric tubing can be stretched beyond its elastic limit until it yields and sets with a permanently reduced diameter. Then the reduced diameter leader portion is inserted from distal to proximal, and the unstretched tubing is pulled in after it. In either case, the tubing is pulled until the distal end is in the position shown, i.e., at the proximal edge of the cutout 22. The ring 28 is installed, and the proximal edge of the liner 27 is trimmed. At this stage, the distal terminator 10 is ready for assembly into the distal ends of the bladder 12 and braid 13. Preferably, the liner 27 has a Shore A hardness of substantially 50 durometer.

After the assembly of the muscle (or pump) is complete, the assembly is bled of air by introducing hydraulic fluid through the muscle proximal end (not shown). The entrapped air and some of the fluid will be ejected out through an axial bore 36 of the liner 27. When the muscle is substantially free of air, the pin 29 is inserted.

Subsequent installation of the steering cable terminator 34 locks the pin 29 in place. If subsequent bleeding should become necessary after installation of the cable, the cable terminator 34 can be removed, and then the pin 29 withdrawn.

With the construction of the terminator 10 as shown, the terminator is reliably leak-tight, simple to fabricate, and relatively low in cost. The bleed feature is reusable, in that a hydraulic muscle (or pump) assembly can be bled repeatedly without need to remove the terminator 10 from the distal ends of the braid and bladder. The hydraulic muscle and/or pump can be easily constructed without special tools or techniques.

The hydraulic muscle and hydraulic pump are of similar construction, and the terminator 10 can be applied favorably to either. Also, the terms such as "distal" and "proximal" are intended for purposes of explanation with respect to the preferred embodiment, and are not intended to limit the invention to any particular orientation.

While the invention has been described in detail with reference to a single preferred embodiment, it should be understood that the invention is not limited to that embodiment. Rather, many modifications and variations would present themselves to those skilled in the art without departing from the scope and spirit of this invention, as defined in the appended claims.

What is claimed is:

1. A terminator with bleed seal for a hydraulic muscle of the type in which an inner elongated tubular elastomeric bladder is situated within an elongated tubular braid and hydraulic fluid is introduced into the interior of the tubular bladder so that the tubular braid expands and shortens as the fluid is introduced into the muscle and lengthens as the hydraulic fluid is withdrawn therefrom, the terminator being situated at a distal end of the muscle to seal the distal end of the bladder and to provide mechanical transfer of force between the distal end of the braid and a device to be moved by the hydraulic muscle; said terminator comprising a generally cylindrical member having an obturator portion that fits into the distal end of the bladder to seal the same and to attach mechancially to the distal end of the braid, and an anchor portion, distal of said obturator portion, onto which said device is connected, said cylindrical member having an axial bore therethrough; a tubular elastomeric liner situated in said bore; a pin fitting removably but snugly within said liner and having means on its distal end to remain distal of said liner and to permit removal of the pin from said bore and liner when desired to bleed air from the bladder; and means to retain said pin in place in the bore and liner blocking axial movement of the pin out of the bore and liner.

2. The terminator with bleed seal as in claim 1 wherein said bore has an elongated diameter distal portion, and further comprising a retaining ring compressing a distal end of said liner against said enlarged distal portion of the bore.

3. The terminator with bleed seal as in claim 1 wherein said liner has a Shore A hardness of substantially 50 durometers.

4. The terminator with bleed seal as in claim 1 wherein said pin is an elongated cylindrical member.

5. The terminator with bleed seal as in claim 4 wherein said pin has its proximal end rounded or tinned.

6. The terminator with bleed seal as in claim 4 wherein said means at the distal end of the pin includes a flared end of the pin.

7. The terminator with bleed seal as in claim 6 wherein said flared end has a hole therethrough permitting grasping of the pin for extraction from the liner.

8. The terminator with bleed seal as in claim 1 wherein said device to which the anchor portion is connected is a cable having a generally cylindrical cable terminator at its end, and said anchor portion includes an axial bore into which the cable terminator lodges against a distal end of said pin.

9. The terminator with bleed seal as in claim 8 wherein said anchor portion has a cutout on at least one side permitting access to the distal end of said pin to facilitate its removal and insertion.

* * * * *